United States Patent [19]

van der Wal et al.

[11] 3,933,072

[45] Jan. 20, 1976

[54] GENERATOR FOR PRODUCING TONES OF A MUSICAL SCALE IN AN ELECTRONIC MUSICAL INSTRUMENT

[75] Inventors: David Josephus van der Wal; Frans Grotepas, both of Eindhoven, Netherlands

[73] Assignee: U.S. Philips Corporation, New York, N.Y.

[22] Filed: Oct. 24, 1974

[21] Appl. No.: 517,781

[30] Foreign Application Priority Data

Oct. 31, 1973 Netherlands ..... 7314925

[52] U.S. Cl. ..... 84/1.01; 84/445; 84/DIG. 11; 328/15; 328/16; 328/20

[51] Int. Cl.[2] ..... G10H 1/00; G10H 5/06

[58] Field of Search ... 84/1.01, 1.22, 1.23, DIG. 11, 84/445; 328/15–18, 20

[56] References Cited

UNITED STATES PATENTS

| | | | |
|---|---|---|---|
| 3,023,659 | 3/1962 | Bode | 84/445 |
| 3,236,931 | 2/1966 | Freeman | 84/1.23 |
| 3,499,090 | 3/1970 | Meyer | 84/1.01 |
| 3,505,461 | 4/1970 | Omura et al. | 84/1.01 |
| 3,515,039 | 6/1970 | Omura et al. | 84/1.01 |
| 3,590,131 | 6/1971 | Reyers | 84/DIG. 11 |
| 3,617,901 | 11/1971 | Franssen | 328/17 |
| 3,674,907 | 7/1972 | Derry | 84/1.01 |
| 3,735,012 | 5/1973 | Hirano | 84/1.01 |
| 3,808,345 | 4/1974 | Franssen | 84/1.01 |
| 3,824,325 | 7/1974 | Obayashi et al. | 84/1.01 |
| 3,877,337 | 4/1975 | Obayashi et al. | 84/1.01 |

*Primary Examiner*—L. T. Hix
*Assistant Examiner*—Stanley J. Witkowski
*Attorney, Agent, or Firm*—Frank R. Trifari; Simon L. Cohen

[57] ABSTRACT

Generator for producing the tones of a musical scale in electronic musical instruments, one master oscillator driving a chain of frequency dividers in a manner such that at the output of each divider a tone is produced which is lower by a semi-tone than the tone at the input of the divider, the final divider of the chain being connected to the input of the first divider via a frequency multiplier which multiplies by a factor of 2, while the master oscillator can be connected to any one of the dividers, in which case the connection of this divider to the preceding one is broken in order to permit transposition without the use of additional dividers.

5 Claims, 5 Drawing Figures

Figure 1:
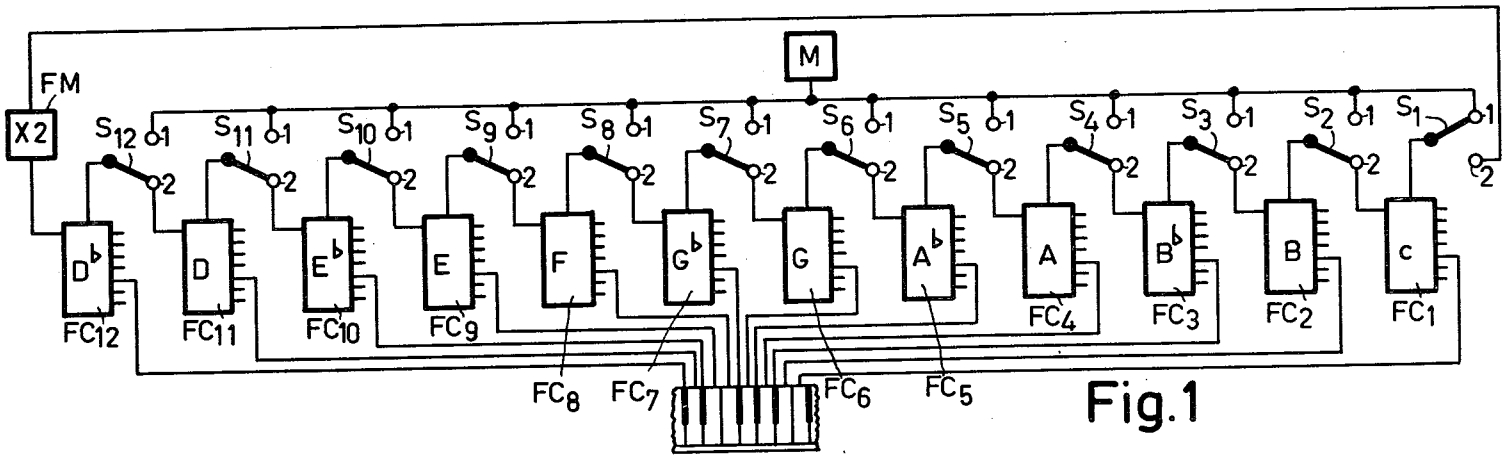

GENERATOR FOR PRODUCING TONES OF A MUSICAL SCALE IN AN ELECTRONIC MUSICAL INSTRUMENT

The invention relates to a generator for producing tones of a musical scale in electronic musical instruments provided with a single master oscillator and with a plurality of frequency converters equal in number to the number of the tones per octave. Each of the frequency converters each have an input and at least a first output. The first output of each frequency converter is connected to the input of the next subsequent frequency converter, while the input of the first converter is connected to the master oscillator.

Such a circuit arrangement is described in Netherlands Patent Application No. 7,109,138 corresponding to U.S. Pat. No. 3,808,345, issued Apr. 30 1974. If in this circuit arrangement the scale is to be transposed, the tuning of the master oscillator is changed in steps. For this purpose it is necessary that the frequency of each step should be highly accurately adjustable with respect to the frequency of the other steps, which requires additional component parts and adjusting time.

According to the invention this is avoided by connecting the first output of the final frequency converter to the input of the first frequency converter via a frequency multiplier which multiplies by a factor of 2. The master oscillator can be switched to the input of any one of the frequency converters, which then can be disconnected from the preceding frequency converter. Thus it is further achieved that the intervals between the various steps are highly accurate and not subject to drift. If the frequency multiplier were omitted, the tones associated with the keys situated above the key corresponding to the frequency converter that is directly driven by the master oscillator would sound too low by an octave.

In an embodiment of a generator according to the invention the input of each frequency converter is connected to the input of a change-over switch which has a first output connected to the master oscillator and a second output connected to the first output of the preceding frequency converter. Thus the members of switches and contacts are reduced to a minimum. The change-over switch is a single pole, double throw switch or its electronic equivalent. As with any single pole double throw switch two terminals are connected to the stationary portions of the switch while a third terminal is connected to a movable member which selectively contacts either of the other two terminals. In order to maintain the description of the switch terminals consistant throughout the specification the first two terminals will hereinafter be called "inputs" of the switch, while the third terminal will be called "outputs," independent of whether signals are connected to or taken from the terminals.

In another embodiment of a generator according to the invention all the change-over switches are intercoupled while a locking device is provided which permits the master oscillator to be connected to only one frequency converter at a time. In this manner erroneous connections are avoided.

In a further embodiment of a generator according to the invention the switches are electronic switches which are operated by means of touch contacts and are mutually interlocked by electronic means. Thus a switch arrangement is obtained which is not subject to wear and does not present electrical interference from "contact bounce."

In still another embodiment of a generator according to the invention the input of each frequency converter is connected to the output of the preceding frequency converter and the master oscillator is greater than the output voltage of each frequency converter. As a result simple on-off switches can be used and there is no longer any need to break the chain of frequency converters, because the voltage of the master oscillator overdrives the frequency converter connected to it to a degree such that this converter responds to the latter voltage only and does not respond to the lower output voltage of the preceding frequency converter.

Figure 2:
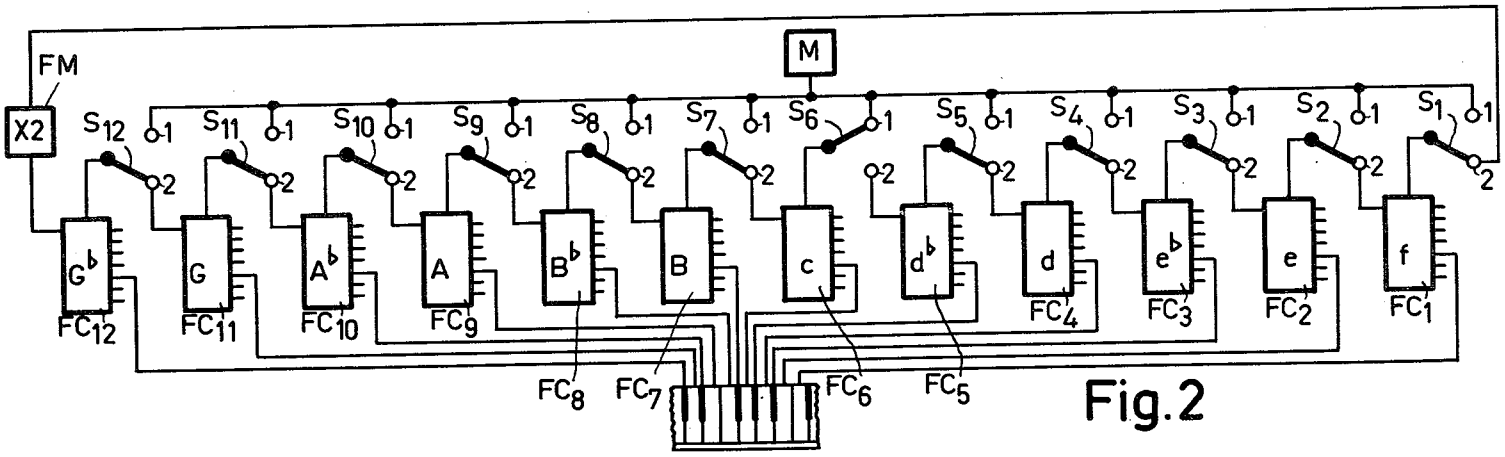
Figure 3:
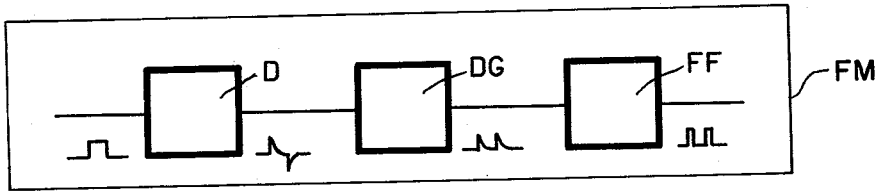
Figure 4:
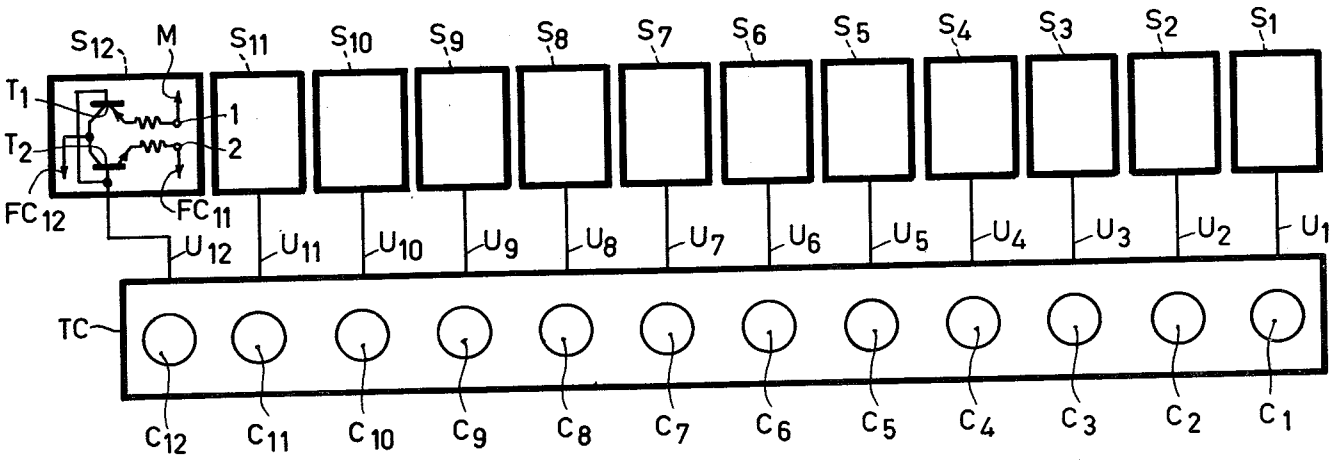
Figure 5:
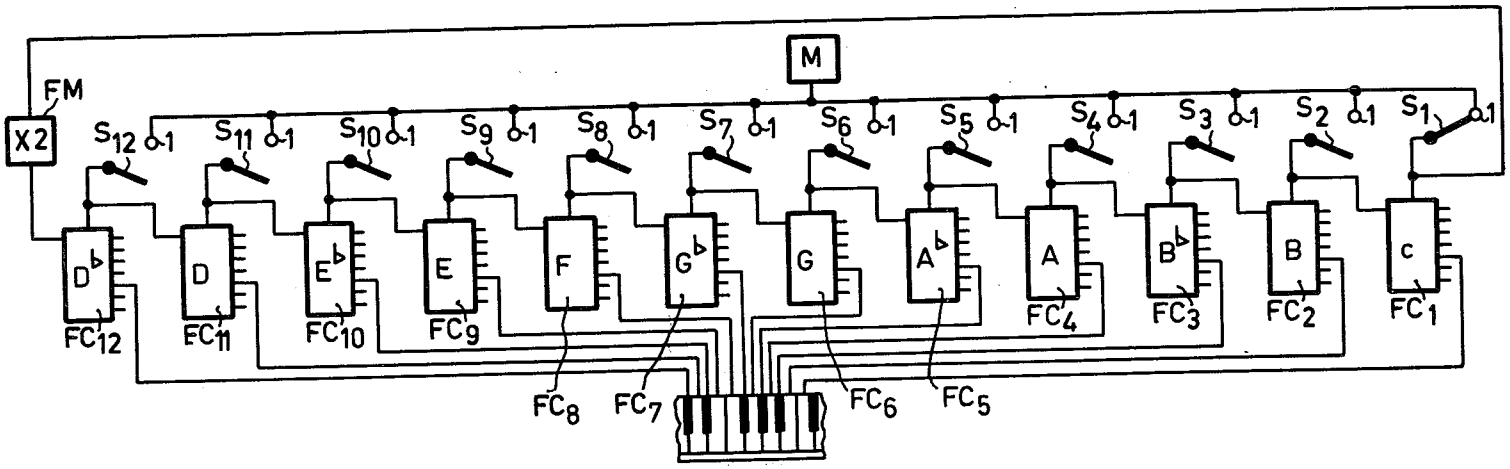

An embodiment of the invention will now be described, by way of example, with reference to the accompanying diagrammatic drawings, in which:

FIG. 1 shows the circuit for a 12-tone scale in the normal non-transposed state, FIG. 2 shows the same circuit transposed upward by an interval of a fourth, FIG. 3 is a block schematic diagram of a multiplying stage, FIG. 4 shows how the change-over switches can be electronically designed and operated, and FIG. 5 shows a circuit including on-off switches.

FIG. 1 shows the positions of the switches in the normal state in which depression of a key causes the associated tone to be sounded in the untransposed state. A master oscillator M is connected to first outputs 1 of change-over switches $S_1$ to $S_{12}$ the inputs of which are connected each to the input of an associated frequency converter $FC_1$ to $FC_{12}$ respectively. Second outputs 2 of the switches $S_2$ to $S_{12}$ are each connected to the output of the preceding frequency converter $FC_1$ to $FC_{11}$ respectively, while the first output of the final frequency converter $FC_{12}$ is connected to the second output 2 of the first switch $S_1$ via a frequency multiplier FM at the output of which a signal is produced which has twice the frequency of the signal applied to the input. In the state shown the inputs of all the switches are connected to their second outputs, except for the switch $S_1$ the input of which is connected to its first output, thus establishing a connection between the first frequency converter $FC_1$ and the master oscillator M. The frequency converters $FC_1$ to $FC_{12}$ used in this embodiment at their first outputs each deliver, for example, a signal which is lower than the signal at its input by a tempered semi-tone, resulting in an equal-tempered scale of 12 tones. The frequency converters each have a plurality of second outputs at which the musically usable octave tones of the signal at the input are produced. These outputs are connected via associated key contacts and filters to the loudspeakers of the musical instrument. If, for example, the C key is depressed, in the loudspeaker a tone at the pitch of this C is produced, and so on.

FIG. 2 shows the same circuit in the state in which the switch $S_6$ is connected to its output 1 while the switches $S_1$ to $S_5$ and $S_7$ to $S_{12}$ are connected to their second outputs 2. As a result, the tone associated with the C key now sounds as the F of higher pitch than the initial C so that the entire scale is shifted upwards by a fourth. Similarly any desired transposition is obtainable by switching the associated switch $S_1$ to $S_{12}$ respectively to its first output 1. A locking device prevents the connection of more than one switch to the first output 1 and ensures that all the other switches are connected to their second outputs 2. Obviously as an alternative, with for example the switch $S_6$ changed over, the master oscillator may be tuned so that in this state the tones normally associated with the keys are produced at the outputs of the frequency converters of $FC_1$ to $FC_{12}$, so that operation of any one of the switches $S_1$ to $S_5$ results in downward transposition while depression of any one of the switches $S_7$ to $S_{12}$ results in upward transposition.

In FIG. 3, which is a block schematic diagram of the frequency multiplier FM, D denotes a differentiating stage to which the output pulses from the final frequency converter $FC_{12}$ are applied to be differentiated. The differentiated pulses at the output of the differentiating stage D are applied to a full-wave rectifier DG in which the negative or positive pulses are converted to pulses of opposite sign so that at the output of the full-wave rectifier DG a train of differentiated pulses is produced which has twice the frequency of the pulse-train applied to the input of the differentiating stage D. If the duration of the pulses is insufficient to drive the succeeding frequency converter FC1, the pulses may be shaped in a monostable multivibrator FF into square-wave pulses of durations sufficient to drive the frequency converter $FC_1$.

FIG. 4 shows the manner in which the switches $S_1$ to $S_{12}$ can be operated by touch contacts and can be in the form of electronic switches. A touch switch TC has 12 touch contacts $C_1$ to $C_{12}$. When any one of these contacts $C_1$ to $C_{12}$ is touched a voltage of negative polarity is set up at the corresponding one of the outputs $U_1$ to $U_{12}$ of the touch switch, a voltage of positive polarity being set up at all the remaining outputs. With respect to the operation of the touch switch TC reference may be made to Netherlands Patent Application No. 7,014,892 corresponding to U.S. Pat. No. 3,740,651, issued June 19, 1973. Depending upon the polarity of the voltages and the outputs $U_1$ to $U_{12}$ of the touch switch TC, one of the frequency converters, for example $FC_{12}$, will be driven by the master oscillator M via the contact 1, in this case with negative polarity of the output $U_1$, because the transistor $T_1$ then is conducting and allows the pulses of the master oscillator M, which in this case are negative-going pulses, to pass, whereas the transistor $T_2$ is non-conducting and does not allow the pulses from the preceding frequency converters $FC_{11}$ to pass, and all the remaining frequency converters are driven each by the preceding frequency converter via the contact 2, because a voltage of positive polarity is set up at the associated outputs of the touch switch TC.

FIG. 5 shows how the switches $S_1$ to $S_{12}$ of FIGS. 1 and 2 may be replaced by simple on-off switches, the input of each frequency converter $FC_1$ to $FC_{12}$ being fixedly connected to the output of the preceding frequency converter $F_{12}$, $FC_1$ to $FC_{11}$ respectively. In this case care should be taken to ensure that the voltage of the master oscillator M is such that the frequency converter connected to the master oscillator responds to this voltage only and does not respond to the output voltage of the preceding frequency converter. Thus an even simpler circuit arrangement is obtained which is highly suitable for use in conjunction with touch contacts.

What is claimed is:

1. Generator for producing tones of a musical scale in electronic musical instruments of the type which comprises one master oscillator and a plurality of frequency converters equal in number to the number of tones per octave, which frequency converters each have an input and at least a first output, the first output of each frequency converter being connected to the input of the next subsequent frequency converter while the input of the first frequency converter is connected to the master oscillator, the improvement comprising a frequency multiplier that multiplies by a factor of 2, means connecting the first output of the final frequency converter to the input of the first frequency converter through said frequency multiplier, and means for switching the master oscillator to the input of any one of the frequency converters and for disconnecting this input from the preceding frequency converter.

2. Generator as claimed in claim 1, wherein said means for switching comprises a change-over switch, the input of each frequency converter being connected to the input of said change-over switch which has a first output connected to the master oscillator and a second output connected to the first output of the preceding frequency converter.

3. Generator as claimed in claim 2, wherein all the change-over switches are intercoupled, and further comprising a locking device which permits the master oscillator to be connected to one frequency converter only.

4. Generator as claimed in claim 1, wherein the switches are electronic switches, touch contacts for operating said switches, said switches being electronically interlocked.

5. Generator as claimed in claim 1, wherein the input of each frequency converter is connected to the output of the preceding frequency converter and in that the voltage of the master oscillator is greater than the output voltage of each of the frequency converters.

* * * * *

UNITED STATES PATENT AND TRADEMARK OFFICE

CERTIFICATE OF CORRECTION

PATENT NO. : 3,933,072

DATED : January 20, 1976

INVENTOR(S) : DAVID JOSEPHUS VAN DER WAL ET AL

It is certified that error appears in the above-identified patent and that said Letters Patent are hereby corrected as shown below:

IN THE SPECIFICATION

Col. 2, line 6, after "and" should be --the voltage of--;

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*